US005799573A

United States Patent [19]

Levy

[11] Patent Number: 5,799,573

[45] **Date of Patent: *Sep. 1, 1998**

[54] PRESS WITH HYDRAULICALLY OPERATED LINKAGE MECHANISM WITH ROLLERS FOR PROVIDING FOUR POINT ROLLER CONTACT

[75] Inventor: Roger Levy, Bloomfield Hills, Mich.

[73] Assignee: Tishken Products, Inc., Detroit, Mich.

[ * ] Notice: The term of this patent shall not extend beyond the expiration date of Pat. No. 5,791,241.

[21] Appl. No.: 710,368

[22] Filed: Sep. 16, 1996

[51] Int. Cl.[6] ..... B30B 1/08

[52] U.S. Cl. ..... 100/271; 72/453.03; 100/285

[58] Field of Search ..... 100/270, 271, 100/272, 280, 281, 283, 285, 291; 72/452.2, 452.8, 453.03; 83/627, 639.1

[56] References Cited

U.S. PATENT DOCUMENTS

| | | | |
|---|---|---|---|
| 153,289 | 7/1874 | Walker | 100/271 |
| 178,174 | 5/1876 | Martin | 100/285 |
| 402,636 | 5/1889 | Webb | 100/272 |
| 553,827 | 2/1896 | Block | 100/285 |
| 2,105,053 | 1/1938 | Patrick | 100/271 |
| 2,135,299 | 11/1938 | Benander | 100/271 |
| 2,204,413 | 6/1940 | Hubbert | 100/271 |
| 3,196,700 | 7/1965 | Gron | 100/285 |
| 3,908,541 | 9/1975 | Meidell | 100/271 |
| 4,457,684 | 7/1984 | Gram . | |
| 4,470,787 | 9/1984 | Gram . | |
| 5,361,662 | 11/1994 | Levy . | |
| 5,365,818 | 11/1994 | Levy . | |
| 5,463,892 | 11/1995 | Nakagawa . | |

*Primary Examiner*—Stephen F. Gerrity
*Attorney, Agent, or Firm*—Dykema Gossett PLLC

[57] ABSTRACT

A single-cylinder hydraulic press has a ram member spaced apart from a lower head die, and a work area being defined therebetween. The cylinder and the piston rod enable reciprocating movement of the ram member relative to the lower head die. A linkage mechanism enables cooperative engagement between the piston rod and the ram member. The linkage mechanism provides rolling contact with the ram member along four distinct linear locations. The linkage mechanism includes four pivot brackets, enabling pivotal rotation of the bell cranks relative thereto, and two lever pins retaining the bell cranks with the piston rod. Sandwiched between the bell cranks are two cam followers, which are driven upwardly and downwardly by the piston rod, the bell cranks each including a pair of rollers which engage with the ram member and provide "four point" contact therewith.

9 Claims, 4 Drawing Sheets

PRESS WITH HYDRAULICALLY OPERATED LINKAGE MECHANISM WITH ROLLERS FOR PROVIDING FOUR POINT ROLLER CONTACT

BACKGROUND OF THE INVENTION

The present invention relates to a hydraulic press, and more specifically, to a hydraulic press actuated by a cylinder and piston rod whereby a linkage mechanism applies force to a ram member through a plurality of roller members.

Hydraulic presses are widely used in numerous applications. Pressure is defined as force acting per unit area. Presses conventionally include a ram member mounted on a plurality of upright guide posts, a ram plate sliding in a horizontal plane relative to the guide posts and a stationary bed.

U.S. Pat. No. 5,463,892 (Nakagawa) discloses a hydraulic press for use as a cold forging press or plastic forming press. The press includes a hydraulic cylinder for driving a movable die of a metal mold on the end of the piston rod relative to a stationary die positioned on the base plate. The molding area is smaller than the end surface of the piston for pressing a workpiece under high pressure.

U.S. Pat. No. 5,361,662 (Levy) discloses a hydraulic press, wherein a hydraulic die base, a hydraulic drive, and a cylinder all slide along rails with the moving workpiece. A spring returns the hydraulic die to its starting point once work on the workpiece has been completed.

U.S. Pat. No. 4,470,787 (Gram) and U.S. Pat. No. 4,457,684 (Gram) disclose a compression molding press having a rapid advance feature of one platen on a movable crosshead relative to a movable lower platen supported on hydrostatic bearings. Hydraulic operated clamping and release cylinders enable rapid locking of the crosshead and the platen it carries.

The use of rollers have been shown to eliminate lateral forces on the guide posts, and reduce the normal wear on internal press surfaces. However, the use of a single roller on a surface provides linear roller contact with the surface, and while the position of the linear contact changes as the position of the linkage mechanism varies, such presses are somewhat unstable and tend to wobble during operation.

What is needed is a lever-type hydraulic press, that takes advantage of roller contact on the ram member, while minimizing the above disadvantages. A low profile hydraulic press is needed that reduces noise, vibration, and wear caused by larger masses moving longer distances.

While roller contact is a major advance in improving press durability, a new type of roller contact is needed that will provide a uniform force across the surface of the ram member, and enable stable vertical movement of the ram member during the power stroke.

SUMMARY OF THE INVENTION

The press generally comprises a movable ram member spaced vertically above a lower head die secured relative to the base. A die set area is defined by and between the undersurface of the ram member and the upper surface of the lower head die.

A single cylinder is mounted upon a cylinder head. The cylinder includes a piston rod. The cylinder head includes a bore therein enabling the piston rod to pass therethrough and engages a linkage mechanism. The single cylinder and the piston rod enable reciprocating movement of the ram member relative to the lower head die.

The linkage mechanism is mounted upon the ram member, and enables cooperative engagement between the piston and the ram member.

In the preferred embodiment, the linkage mechanism includes four pivot brackets, each being mounted symmetrically about a corner of the cylinder head. Two bell cranks are pivotally connected between opposing pairs of the pivot brackets. Each bell crank is cooperatively engaged with the piston rod through a lever pin.

The linkage mechanism enables cooperative linear engagement between the piston rod along four distinct locations of the upper surface of the ram member. Each of the bell cranks cooperatively engages a pair of rollers for rolling engagement with the upper surface of the ram member, enabling "four-point" contact.

The ram member is urged toward the lower head die when the piston rod is extended, and the ram member is withdrawn when the piston rod is retracted. The mechanical advantage of the linkage mechanism may be adjusted by varying the size of the lever arms of the bell cranks.

For a more complete understanding of the hydraulic press of the present invention, reference is made to the following detailed description and accompanying drawings in which the presently preferred embodiment of the invention is shown by way of example. As the invention may be embodied in many forms without departing from spirit of essential characteristics thereof, it is expressly understood that the drawings are for purposes of illustration and description only, and are not intended as a definition of the limits of the invention. Throughout the description, like reference numbers refer to the same component throughout the several views.

DETAILED DESCRIPTION OF THE PREFERRED EMBODIMENT

Figure 1:
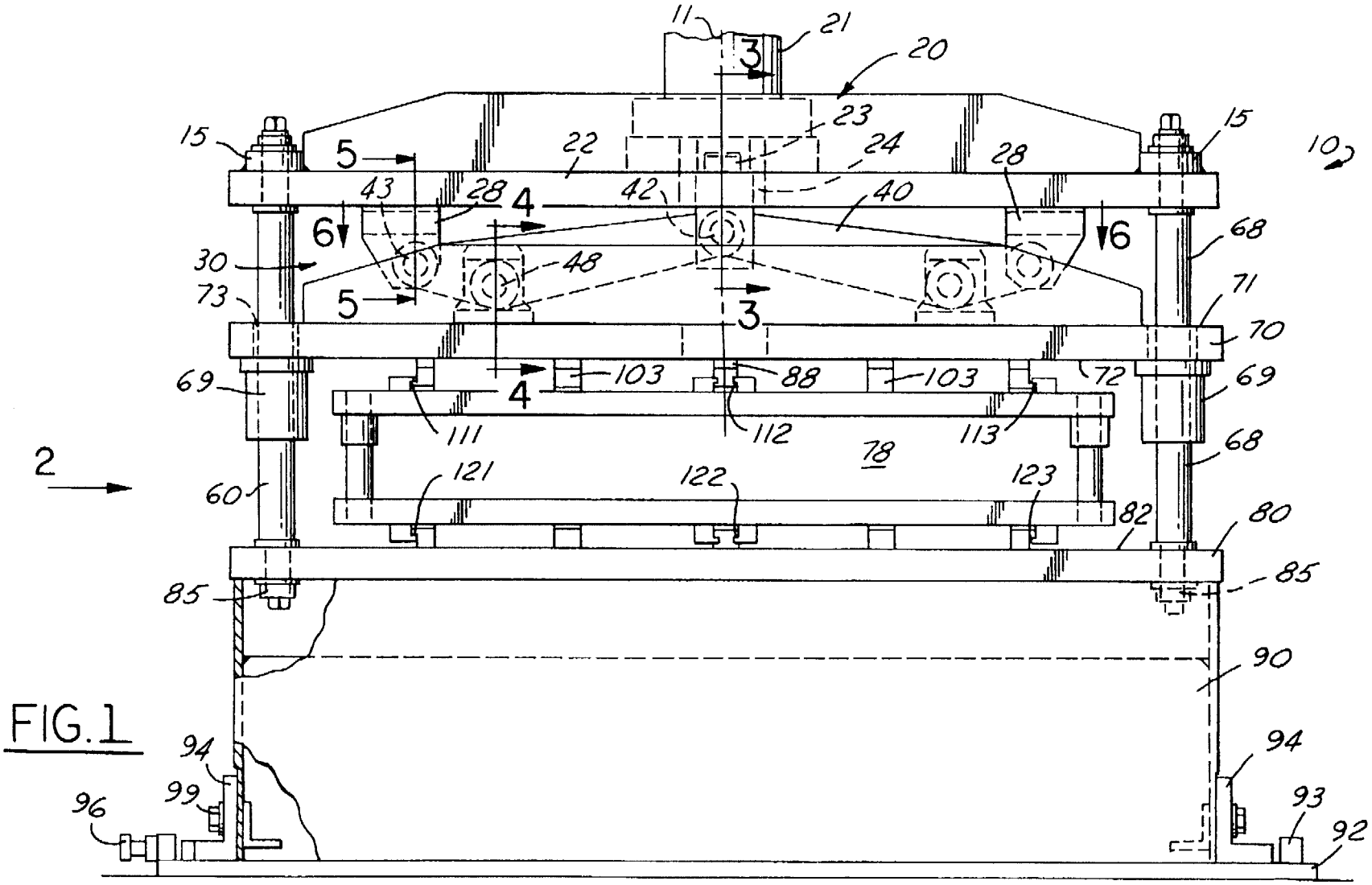
FIG. 1 is a front elevational view of the preferred embodiment embodying the hydraulic press of the present invention, the piston and piston rod, and the linkage mechanism being in the retracted position.
Figure 2:
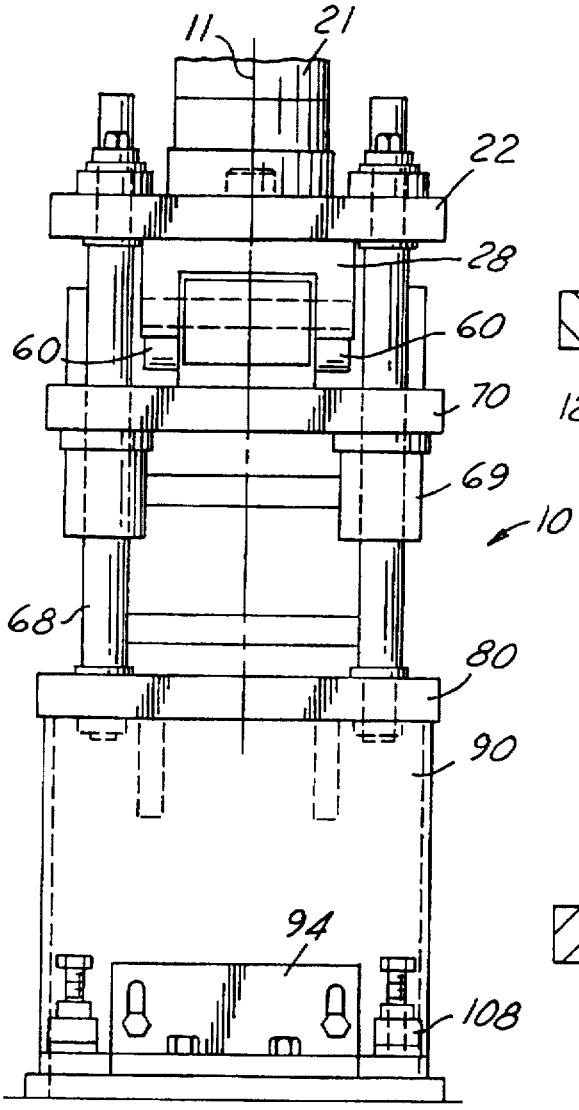
FIG. 2 is a side elevational view of the hydraulic press of FIG. 1, with the piston and piston rod, and the linkage mechanism in the retracted position.

Turning now to the drawings, FIGS. 1 and 2 disclose front and side elevational views, respectively, of the preferred embodiment of the hydraulic press [10] having a vertically extending longitudinal axis 11.

The hydraulic press [10] generally includes a hydraulic cylinder assembly [20], a linkage mechanism [30] having a pair of bell cranks or levers [40], a ram member or upper movable die head [70] spaced vertically above a stationary lower die head [80] disposed on the press base [90]. A die set area [78] is defined between the undersurface [72] of the ram member [70] and the upper surface [82] of the lower die head [80].

Figure 3:
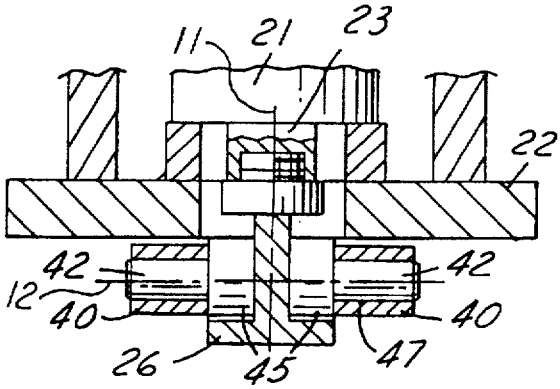
FIG. 3 is a side cross-sectional view of the piston and piston rod of the hydraulic press of the present invention in the retracted position, taken along lines 3—3 of FIG. 1.

The hydraulic cylinder assembly [20] includes a single, upright, high-pressure, hydraulic cylinder [21] mounted upon a stationary cylinder head or top plate [22] of the press [10]. The cylinder [21] has a reciprocating piston [23] and an axially connected piston rod [26] for upward and downward engagement. The cylinder [21] and the piston rod [26] enable reciprocating movement of the ram member [70] relative to the lower die head [80]. The cylinder head [22] includes a bore [24] that is centrally disposed therewithin and is cylindrical in shape, enabling the piston rod [26] to pass therethrough. The piston rod [26] has a generally upright, I-shaped cross-section as shown in FIG. 3, the bottom flange portion of which receives a pair of cam followers [45] having opposed lever or mounting pins [42], one for each bell crank [40] of the linkage mechanism [30].

Figure 4:
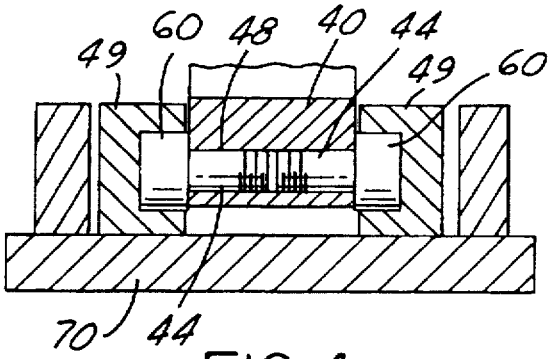
FIG. 4 is a side elevational view of the roller and roller pin of the linkage mechanism of the hydraulic press of FIG. 1, taken along lines 4—4 of FIG. 1.
Figure 8:
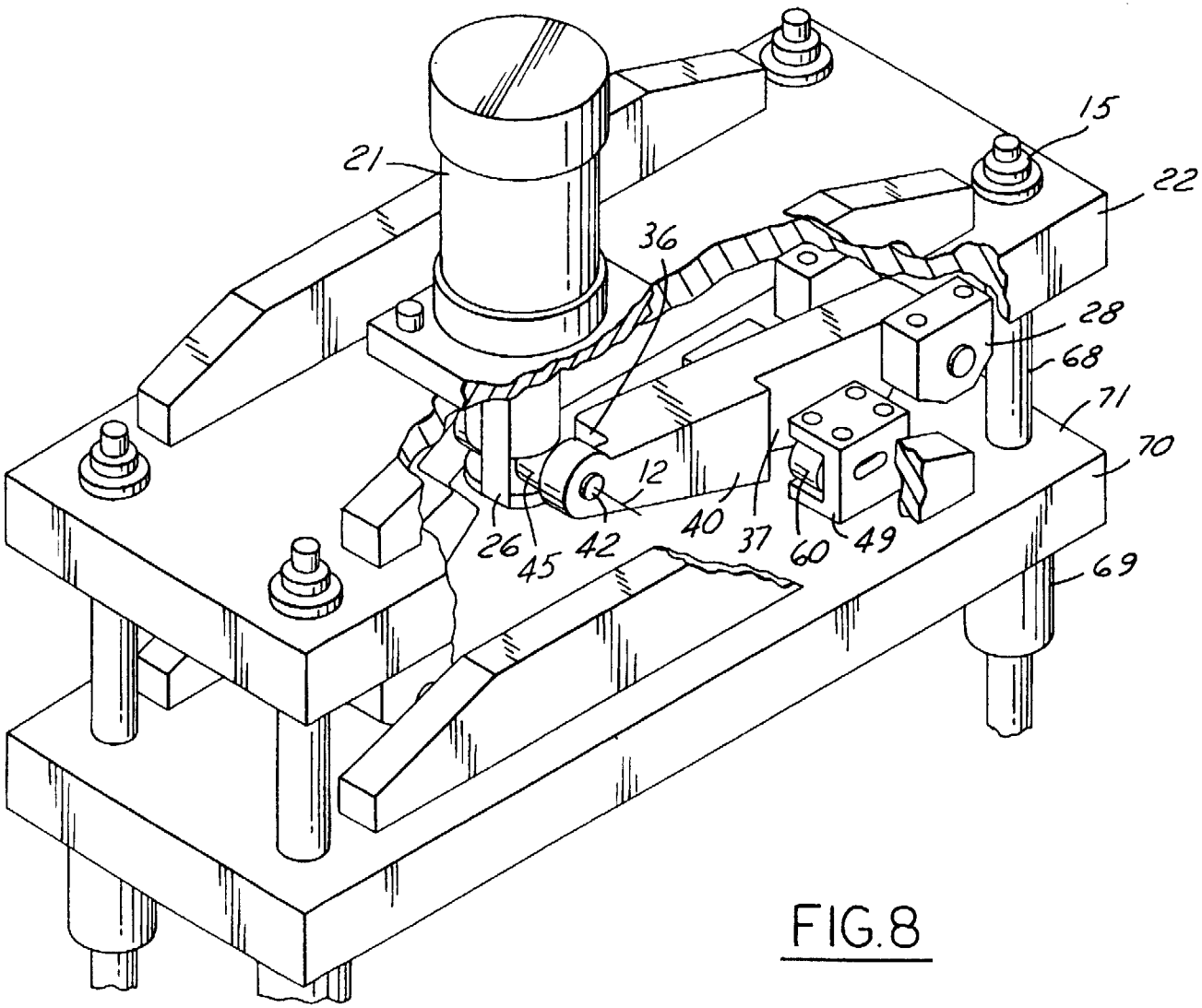
FIG. 8 is an enlarged, isometric, partial cutaway, view of the linkage mechanism of the hydraulic press of FIG. 1, with the piston, piston rod, and linkage mechanism in the retracted position.

The linkage mechanism [30] enables cooperative rolling engagement between the piston [23] and four distinct locations on the upper surface [71] of the ram member [70] (see FIG. 8). The linkage mechanism [30] includes two bell cranks or levers [40], a pair of lever or mounting pins [42] for the cam followers [45], four roller pins [44] mounted within four roller returns [49], along with four cylindrical rollers [60] as shown in FIG. 4.

Figure 5:
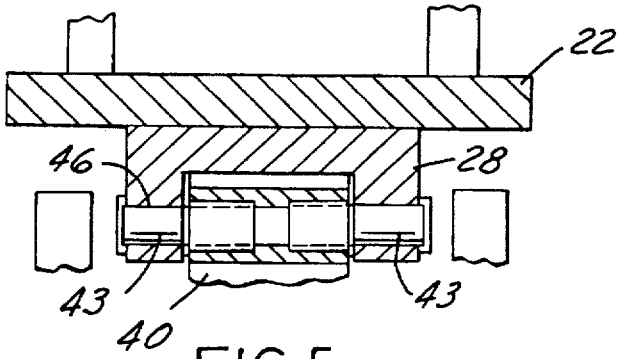
FIG. 5 is a side cross-sectional view of the pivot bracket and pivot pin of the hydraulic press of the present invention, taken along lines 5—5 of FIG. 1.

The cylinder head [22] also includes a pair of pivot brackets [28] for mounting the linkage mechanism [30] therebetween. The pair of pivot brackets [28] are spaced-apart opposing each other and are mounted onto the cylinder head [22], extending downwardly therefrom. Each pivot bracket [28] has a generally C-shaped configuration as shown in FIG. 5, with the center portion of each pivot bracket [28] extending from and secured to the cylinder head [22]. Each leg of the pivot bracket [28] includes opposing apertures [29] for mounting and retaining a pair of bracket pins [43] therewithin. The pivot bracket in combination with each pair of bracket pins [43] supports an opposing bell crank [40] and enables pivotal engagement to the linkage mechanism [30].

The bell cranks [40] are fixedly retained in a pivotal manner relative to the pivot brackets [28]. Each lever or mounting pin [42] is retained relative to the piston rod [26], and moves the same distance as the piston rod [26] during the power stroke.

As used herein, the top, front, and end planes relative to linkage mechanism [30] are normal to each other. The front plane is normal to the axis of the lever pins [42], the axes of the bracket pins [43], and the axes of the roller pins (see FIG. 1). The end plane is parallel to the plane defined by the intersection of the axis of the upward–downward motion of the piston rod [26] with the intersection of the axes of the lever pins [42] (FIG. 2 is the end view of the linkage mechanism [30]). The top plane is parallel to the roller surface contact area on the ram member [70], as shown in FIG. 3.

As viewed from the front plane (see FIG. 7), the bell cranks [40] have a generally triangular shape with rounded angles. The two smallest angles, the lever pin angle [32] and the bracket pin angle [33] are thickened and extend around the adjoining legs of the triangular shape. The front and rear surfaces of the bell cranks [40] are parallel to the front plane.

The bell crank [40] is best seen in FIG. 8. A portion of each bell crank [40] nearest the piston rod [26] is truncated to enable clearance for the centrally disposed cam followers [45]. The cam truncation [36] is formed by the intersection of one plane parallel to the nearest tangential surface of the cam follower [45] and a second plane parallel to the front plane. A portion of each bell crank [40] nearest the surface that engages the lever pin [42] is also truncated to enable clearance for the pivot bracket [28] and a cam roller return [49]. The bracket truncation [37] is formed by the intersection of one plane parallel to the front surface, and a second plane parallel to and aligned with the nearest tangential surface of the cam follower [45] of the cam truncation [36].

Figure 6:
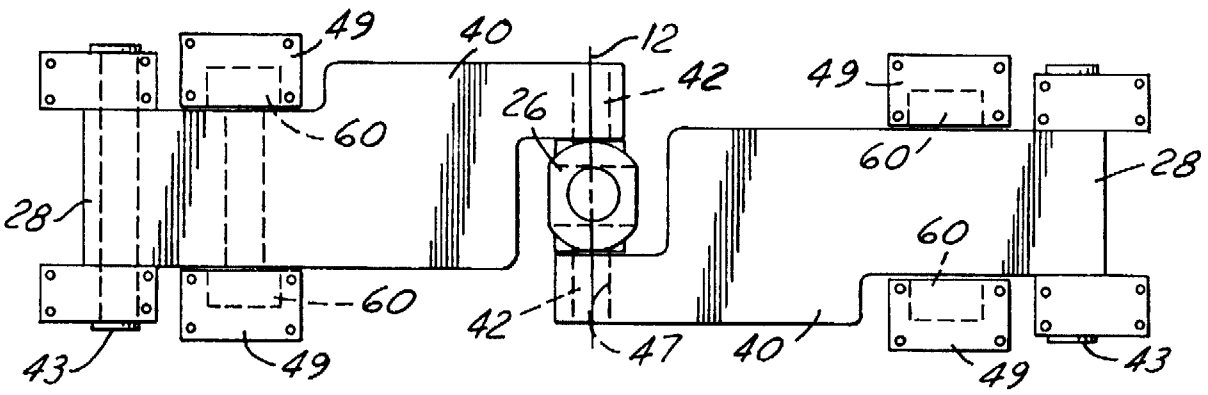
FIG. 6 is a top elevational view of side cross-sectional view of the piston, piston rod, and linkage mechanism in the retracted position taken along lines 6—6 of FIG. 1.

The two identical bell cranks or levers [40] diagonally oppose each other as mounted on the bracket pins [43] of the pivot brackets [28] (see FIG. 6). Each leg of the bell crank [40] is of different length. Each bell crank [40] includes a cylindrically-shaped angular bore disposed near the intersection of each pair of the three legs thereof enabling pivotal connection of the linkage mechanism [30]. Each bell crank [40] includes a cylindrically-shaped bracket angular bore [46], FIG. 5 enabling engagement of the bell crank [40] with the bracket pin [43] and the pivot bracket [28]. Each bell crank [40] includes a cylindrically-shaped roller angular bore [48] enabling engagement between two opposed roller pins [44] and respective rollers [60] as shown in FIG. 4. Each bell crank [40] includes a lever angular bore [55] enabling rolling engagement between each bell crank [40] and the piston rod [26].

Each roller [60] is positioned within a cam-roller return [49] having the general shape of an upright C-block, which is mounted onto the upper surface of the ram member [70] as seen in FIG. 4. The movement of the rollers [60] downward forces the ram member [70] downward toward the lower die head [80]. All four rollers [60] move the same distance during the power stroke outwardly and downwardly away from the piston rod [26] when the piston rod [26] is becoming extended, and inwardly and upwardly when the piston rod [26] is becoming retracted. The two pairs of rollers [60] are symmetrical as positioned about the upper surface [71] of ram member [70].

The roller pins [44] engagement similarly rolls outwardly as the piston rod [26] is extended, and moves inwardly when the piston rod [26] is retracted. The engagement between the C-shaped roller returns [49] and the roller pins [44] directs the vertical force of the piston rod [26] downwardly into the ram member [70].

Sandwiched between the lever angular bores [47] (FIG. 3) of the two bell cranks [40] are a pair of cylindrical-shaped cam followers [45] for cooperative engagement with the reciprocating piston rod [26] as the piston rod [26] moves upwardly and downwardly. The first lever pin [42] extends through the lever angular bore [47] of the first bell crank [40], the cam follower corresponding [45], and the second lever pin [42] extends through the other lever angular bore [47] of the cam follower [45] of the second bell crank [40]. Cam followers 45 and mounting or lever pins 42 are located on a transverse axis 12 (FIGS. 6 and 8) which is perpendicular to the longitudinal axis 11. As shown in FIG. 6, the inner ends of the first and second levers are spaced apart along the transverse axis 12.

The lever leg [41] is the longest of the three legs of the bell crank [40]. The lever leg [41] may be lengthened or shortened to vary the mechanical advantage of each bell crank [40]. Since the bell cranks [40] are identical to each other, the mechanical advantages of the two bell cranks [40] are the same. The roller angular bore [48] opposes the lever leg [41], and the bracket angular bore [46] is nearest the roller angular bore [48].

Figure 7:
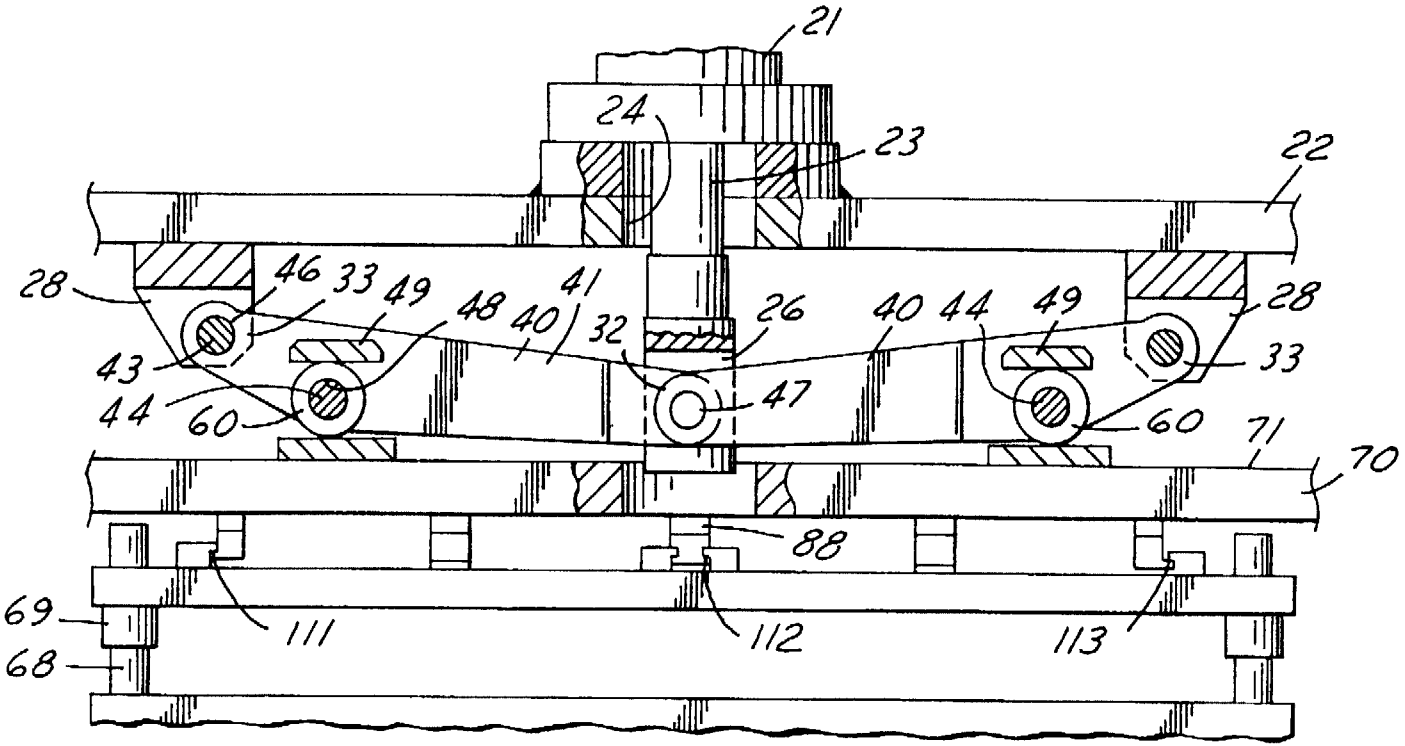
FIG. 7 is a partial cutaway front elevational view of the linkage mechanism of the hydraulic press of FIG. 1, with the piston, piston rod, and linkage mechanism in the extended position.

Each bell crank [40] pivots about its respective bracket pin [43], and the bracket angular bore [46]. When the piston rod [26] is in the retracted position as shown in FIG. 1, the ram member [70] is raised from the lower die head [80], and when the piston rod [26] is in the extended position as shown in FIG. 7, the ram member [70] is in its lowermost position relative to the lower die head [80]. As the power stroke begins, the piston rod [26] moves downwardly relative to the cylinder head [22], as the lever pins move with the piston rod [26].

During the power stroke, the piston rod [26] moves into the extended position, repositioning the bell cranks [40] downwardly and outwardly away from the piston rod [26]. When the piston rod [26] is repositioned into the retracted position, the bell cranks [40] are pulled upwardly and inwardly toward the piston rod [26].

Force is transmitted from the piston rod [26] to the upper surface [71] of the ram member [70] by means of the four rollers [60]. A pair of rollers [60] are disposed about opposing ends of each roller pin [44], as positioned within the roller angular bore [48] of each bell crank [40], providing "four-point" roller contact on the upper surface [71] of the ram member [70]. The rollers [60] are made by McGill Corp., and are CFH-5-S camrols.

The linkage mechanism [30] has a low profile, with a vertical height of up to seven inches, but preferably only about six inches. The capacity of the hydraulic press [10] is from 40 to 150 tons.

The four upright drawbars [68] extend from the press base [90] through the cylinder head [22]. The ram member [70] has corresponding bores [73] disposed at each corner thereof. The ram member [70] slidably receives the four upright drawbars [68] through four bushings [69] disposed at the undersurface [72] of the ram member [70], respectively, enabling movement of the ram member [70] relative to the drawbars [68]. Fastener means [15] secure each drawbar [68] to the cylinder head [22] and fasteners [85] secure each drawbar to the lower die head [80].

The ram member [70] is horizontal throughout the power stroke. The ram member [70] is urged toward the lower die head [80] when the piston rod [26] is extended, and the ram member [70] is withdrawn from the lower die head [80] when the piston rod [26] is retracted.

Three die slides [111, 112, and 113] are provided on the undersurface [72] of the ram member [70], and three more die slides [121, 122, and 123] are disposed on the upper surface [82] of the base plate [80] to secure a die set (not shown) thereto in a conventional manner. Also, a center rail [88], in general alignment with the piston rod [26], is sandwiched between two support rails [103], to further support the die set.

The press base [90] is positioned upon a foundation [92] and secured thereto by fastener means [93] which are retained onto and through a pair of angle plates [94] opposing each other (see FIG. 1). A pair of horizontally disposed adjustable screw [96] cooperatively engage each angle support [94] to align the press base [90] with the rollers [60]. Each angle plate [94] is disposed between a pair of support blocks [108] for support to the foundation [92]. Also, a pair of fasteners [99] extend through apertures (not shown) in the press base [90] and the angle plates [94].

Furthermore, it is evident that many alternatives, modifications, and variations of the hydraulic press [10] of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

What I claim is:

1. A press having a vertically extending longitudinal axis comprising:

a stationary lower die head;

spaced upright guide posts having upper and lower ends mounted upon said stationary lower die head at said lower ends and secured thereto;

an apertured movable ram member guidably receiving and reciprocally mounted from said guide posts;

said lower die head and said ram member being spaced apart to define therebetween a die set area;

said ram member having an upper surface and a lower surface;

a top plate secured over the upper ends of said guide posts and spaced above the upper surface of said movable ram member;

said top plate having upper and lower surfaces, with said lower surface being spaced from the upper surface of said moveable ram member to provide a space therebetween;

pivot brackets connected to and depending from said top plate into the space between said top plate and said moveable ram member;

an opening in said top plate surrounding said longitudinal axis;

a linkage mechanism interposed in the space between said top plate and said movable ram member;

said linkage mechanism comprising first and second levers having inner and outer ends;

pivot means for connecting the outer ends of said first and second levers respectively to said pivot brackets;

the inner ends of said first and second levers being spaced apart along a transverse axis which is perpendicular to said longitudinal axis;

a fluid cylinder mounted on said top plate and having a piston rod extending through said opening along said longitudinal axis;

said piston rod having an I-shaped cross-section to provide a bottom flange which is located below said transverse axis;

cam followers mounted on the inner ends of said first and second levers in the space provided between said inner ends and having rolling contact with said bottom flange of said piston rod; and said first and second levers including intermediate portions engaging the upper surface of said movable ram member;

the energization of said fluid cylinder being effective to extend said piston rod and thereby apply a force to said cam followers and the inner ends of said first and second levers causing said first and second levers to pivot about the pivot means of said pivot brackets thereby vertically moving said movable ram member as a result of the engagement of said intermediate portions of said first and second levers with said movable ram member.

2. The press of claim 1, wherein said cam followers are mounted by mounting pins to the inner ends of said first and second levers.

3. The press of claim 1, wherein each of said intermediate portions is provided with a roller pin, said roller pin having a pair of end portions provided with cylindrical rollers for transmitting the force of the fluid cylinder to said movable ram member.

4. The press of claim 3, wherein said upper surface of said movable ram member is provided with two pairs of spaced apart cam-roller returns upon which said rollers ride when transmitting the force from said piston rod to effect movement of said moveable ram member.

5. The press of claim 1, wherein the extension of said cylinder rod controls the position of said cam followers.

6. The press of claim 1, wherein a press base is provided for mounting the press for limited vertical and horizontal adjustments.

7. The press of claim 1, wherein said fluid cylinder is a hydraulic cylinder.

8. The press of claim 1, wherein said first and second levers are in the form of bell cranks which are spaced apart, each bell crank being connected by said pivot means to one of said pivot brackets.

9. The press of claim 1, wherein said cam followers have positive contacts between said piston rod and the lower surface of said top plate.

* * * * *